US005591002A

United States Patent [19]

Cunha et al.

[11] Patent Number: 5,591,002

[45] Date of Patent: Jan. 7, 1997

[54] CLOSED OR OPEN AIR COOLING CIRCUITS FOR NOZZLE SEGMENTS WITH WHEELSPACE PURGE

[75] Inventors: Francisco J. Cunha, Schenectady; Alan Walker, Niskayuna, both of N.Y.

[73] Assignee: General Electric Co., Schenectady, N.Y.

[21] Appl. No.: 509,917

[22] Filed: Aug. 1, 1995

Related U.S. Application Data

[63] Continuation-in-part of Ser. No. 414,697, Mar. 31, 1995, which is a continuation-in-part of Ser. No. 294,671, Aug. 23, 1994, abandoned.

[51] Int. Cl.[6] ..... F01D 9/06

[52] U.S. Cl. ..... 415/115; 416/96 A

[58] Field of Search ..... 415/115, 116, 415/914; 416/96 R, 96 A, 97 R, 97 A

[56] References Cited

U.S. PATENT DOCUMENTS

| | | | |
|---|---|---|---|
| 3,628,880 | 12/1971 | Smuland et al. . | |
| 3,628,885 | 12/1971 | Sidenstick et al. | 416/96 A |
| 3,806,275 | 4/1974 | Aspinwall | 416/97 R |
| 3,807,892 | 4/1974 | Frei et al. . | |
| 3,891,348 | 6/1975 | Auxier | 416/96 A |
| 4,017,207 | 4/1977 | Bell et al. . | |
| 4,297,077 | 10/1981 | Durgin et al. | 416/97 R |
| 4,355,952 | 10/1982 | Brown et al. . | |
| 4,379,677 | 4/1983 | Hallinger et al. . | |
| 4,573,865 | 3/1986 | Hsia et al. . | |
| 4,666,368 | 5/1987 | Hook, Jr. et al. . | |
| 4,721,433 | 1/1988 | Piendel et al. . | |
| 4,826,397 | 5/1989 | Shook et al. . | |
| 5,100,291 | 3/1992 | Glover . | |
| 5,116,199 | 5/1992 | Ciokajlo . | |
| 5,205,115 | 4/1993 | Plemmons et al. . | |
| 5,219,268 | 6/1993 | Johnson . | |
| 5,232,343 | 8/1993 | Butts . | |
| 5,253,976 | 10/1993 | Cunha . | |
| 5,259,730 | 11/1993 | Damlis et al. . | |
| 5,320,485 | 6/1994 | Bourguignon et al. . | |
| 5,363,654 | 11/1994 | Lee . | |
| 5,391,052 | 2/1995 | Correia et al. . | |
| 5,399,065 | 3/1995 | Kudo et al. | 415/115 |

OTHER PUBLICATIONS

"Advanced Cooled First Stage Vane Design," Levari et al., ASME 84–GT–219.

"Flow in Corners of Passages with Non–Circular Cross–Sections," Eckert et al., ASME Paper, Aug. 22, 1955.

*Primary Examiner*—Edward K. Look
*Assistant Examiner*—Christopher Verdier
*Attorney, Agent, or Firm*— Nixon & Vanderhye

[57] ABSTRACT

The nozzle segment includes a vane having a plurality of axially spaced cavities for transmission of a cooling medium. In a closed circuit cooling system, air is transmitted radially inwardly and outwardly through inserts in leading and intermediate cavities, respectively, for flow through holes for impingement cooling of the adjoining vane surfaces. Radial inlet flow of cooling medium to an aft cavity likewise flows through an insert for impingement cooling of the aft cavity walls. The cooling medium flows from the aft cavity into a trailing edge cavity for impingement cooling of the trailing edge. The spent cooling flow passes through a channel in the diaphragm into the wheelspace. In the open air circuit, the spent impingement flow in the leading and intermediate cavities passes through openings in the vane wall for thin film cooling of the vane. An insert is received in the trailing edge cavity for impingement cooling of the trailing edge walls and flow towards the trailing edge on opposite sides of a tongue for turbulent flow through a multiplicity of openings through the trailing edge into the hot gas stream.

12 Claims, 5 Drawing Sheets

CLOSED OR OPEN AIR COOLING CIRCUITS FOR NOZZLE SEGMENTS WITH WHEELSPACE PURGE

RELATED APPLICATIONS

This application is a continuation-in-part of application Ser. No. 08/414,697, filed Mar. 31, 1995, entitled "Turbine Stator Vane Segments having Combined Air and Steam Cooling Circuits" (Attorney Docket 839-354; 51DV-5518) and which application is a continuation-in-part of application Serial No. 08/294,671, filed Aug. 23, 1994, now abandoned these two applications being incorporated herein by reference.

TECHNICAL FIELD

The present invention relates generally to land-based gas turbines, for example, for electrical power generation, and particularly to closed and open air cooling circuits for a nozzle stage of the turbine.

BACKGROUND

The traditional approach for cooling turbine blades and nozzles is to extract high pressure cooling air from a source, for example, by s extracting air from the intermediate and last stages of the turbine compressor. External piping is used to supply air to the nozzles with air film cooling typically being used, the air exiting into the hot gas stream of the turbine. In advanced gas turbine designs, it has been recognized that the temperature of the hot gas flowing past the turbine components could be higher than the melting temperature of the metal. It is therefore necessary to establish a cooling scheme to protect the hot gas path components during operation. Steam supplied in a closed circuit to cool gas turbine nozzles (stator vanes) has been demonstrated to be a preferred cooling medium, particularly for combined cycle plants. See, for example, U.S. Pat. No. 5,253,976, of common assignee herewith. Because steam has a higher heat capacity than the combustion gas, it is inefficient to allow the coolant steam to mix with the hot gas stream. Consequently, it is desirable to maintain cooling steam inside the hot gas path components in a closed circuit. It has been found, however, that certain areas of the components of the hot gas path cannot practically be cooled with steam in a closed circuit. For example, the relatively thin structure of the trailing edges of the nozzle vanes effectively precludes steam cooling of those edges.

DISCLOSURE OF THE INVENTION

For purposes of this discussion, the closed or open air cooling circuits for the nozzle or nozzles of this invention constitute one aspect of a novel and improved turbine which is the subject of a number of co-pending patent applications, certain of which are listed below. In that turbine, preferably four stages are provided, with an inner shell mounting the first and second stage nozzles, as well as the first and second stage shrouds, while an outer shell mounts the third and fourth stage nozzles and shrouds. Such turbine is designed for conversion between air and steam cooling of the rotational and stationary components. In a closed circuit steam cooling system for the above-noted turbine, closed circuit steam cooling supply and spent cooling steam return conduits for the nozzles, as well as closed circuit steam cooling conduits for the turbine rotor for delivery of the cooling steam to the buckets of the first and second stages, and the rotor wheel cavities and the rotor rim are provided. Where an air cooled turbine is desired, cooling air may be supplied to the stationary components, e.g., the first and second stage nozzles, as part of high pressure discharge air from the compressor. The cooling air may be supplied in an open circuit exiting the partitions or vanes of the first and second stage nozzles into the hot gas stream for film cooling. Cooling air may similarly be piped directly through the outer shell to the third stage nozzle while the fourth stage nozzle remains uncooled. Open air cooled circuits are also provided for the rotational components of the turbine, i.e., the buckets, in a conventional manner.

The present invention addresses the provision of an air cooled turbine using either a closed or open cycle system which fundamentally has commonality with components of the steam cooled nozzles.

To summarize the state of development of this new turbine, the use of inner and outer shells to support stationary components of the turbine which can be converted between air and steam cooling is described and illustrated in co-pending patent application Ser. No. 08/414,698, entitled "Removable Inner Turbine Shell with Bucket Tip Clearance Control" (Attorney Docket No. 839-346), the disclosure of which is incorporated herein by reference. For a complete description of the steam cooled buckets, reference is made to companion co-pending application Ser. No. 08/414,700, entitled "Closed Circuit Steam Cooled Bucket" (Attorney Docket No. 839-352), the disclosure of which is incorporated herein by reference. Air cooled buckets are well known in the art. For a complete description of the steam (or air) cooling circuit for supplying cooling medium to the first and second stage buckets through the rotor, reference is made to co-pending patent application Ser. No. 08/414,695, entitled "Closed or Open Circuit Cooling of Turbine Rotor Components" (Attorney Docket No. 839-358). For a complete description of the steam cooled nozzles with air cooling along the trailing edge, reference is made to companion co-pending application Ser. No. 08/414,697, entitled "Turbine Stator Vane Segments having Combined Air and Steam Cooling Circuits" (Attorney Docket No. 839-354), the disclosure of which is incorporated herein by reference. The present invention therefore addresses the air cooled stator nozzles, particularly a second stage nozzle for that turbine, when the turbine is provided initially as an air cooled turbine.

In accordance with the present invention, there is provided an air cooling system for cooling the hot gas components of a nozzle stage of a gas turbine, for example, the second nozzle stage, in which closed circuit air cooling or open circuit air cooling systems may be employed. In the closed circuit system, a plurality of nozzle vane segments are provided, each of which comprises one or more nozzle vanes extending between inner and outer side walls. The vanes have a plurality of cavities in communication with compartments in the outer and inner side walls for flowing air in a closed circuit for cooling the outer and inner walls and the vanes per se. This closed circuit air cooling system is substantially structurally similar to the steam cooling system described and illustrated in the prior referenced patent application Ser. No. 08/414,697 (Attorney Docket No. 839-354), with certain exceptions as noted below. Thus, air may be provided a plenum in the outer wall of the segment for distribution in chambers therein and passage through impingement openings in a plate for impingement cooling of the outer wall surface of the segment. The spent impingement cooling air flows into leading edge and aft cavities extending radially through the vane. A return air intermediate cooling cavity extends radially and lies between the leading edge and aft cavities. A separate trailing edge cavity is also provided.

The air flow through the leading edge cavity flows into a plenum in the inner wall, through impingement openings in an impingement plate for impingement cooling of the inner wall of the segment. The spent impingement cooling air then flows through the intermediate return cavity for further cooling of the vane. In each of the leading edge, intermediate and aft cavities, inserts are provided which bear against generally radially spaced axially extending ribs, the inserts having impingement flow holes. Thus, impingement cooling air flows through the inserts, through the impingement holes for impingement cooling of the surfaces of the vane. In the leading edge and intermediate cavities, return flow channels are provided in communication with gaps between the ribs. In the aft cavity, however, the flow channels between the ribs flows air through radially spaced openings in a vane wall to introduce the cooling air into the trailing edge cavity. The flow of cooling air in the trailing edge cavity per se is the subject of a further U.S. patent application Ser. No. 08/509,918 entitled "Impingement Cooling for Turbine Stator Vane Trailing Edge," and filed Aug. 1, 1995 (Attorney Docket No. 839-349; 51DV-5511), the subject matter of which is incorporated herein by reference. The cooling air from the trailing edge cavity flows to the inner wall for flow through a passage for supplying purge air to the wheelspace.

In the open air cooling circuit hereof, leading edge, intermediate and trailing edge cavities are provided in the vane. Air is supplied within inserts in the leading, intermediate and trailing edge cavities and between the intermediate insert and the wall of the intermediate cavity. The cooling air supplied into the leading and trailing edge inserts flows through the impingement openings of the inserts for impingement cooling of the vane walls. In the leading edge cavity, the spent impingement air flows through openings in the vane walls at radially spaced positions therealong and into the hot gas path for film cooling of the vane along both the pressure and suction sides of the vane. The air flowing within the insert in the intermediate cavity flows directly radially inwardly to the inner wall for flowing cooling air into the wheelspace. That is, the air flow within the intermediate insert is dedicated to cooling the inner side wall and discharge through the diaphragm. The air channeled between the intermediate insert and the interior wall of the intermediate cavity exits into the hot is gas path through radially spaced openings for film cooling the vane along the pressure side of the vane. Turbulators are provided in this channel to enhance the cooling effect of the air flow along the interior walls of the intermediate cavity toward the thin film cooling openings. That is, in principle, there is a reduction in the magnitude of air flowing for cooling purposes so that as the cooling air heats and the temperature level rises so that the air is no longer adequate for any cooling, the air is directed outwardly for thin film cooling, it being recognized that the cooling air remains at a lower temperature than the temperature of the hot gas flowing through the nozzle.

The trailing edge cavity includes an insert as well as a projection or tongue aft of the insert and spaced from the trailing edge. Cooling air flows into the insert and through its impingement openings for impingement cooling of the vane walls. Radially spaced flow dividers (ribs) then direct the air generally toward the trailing edge between the tongue and the interior wall surfaces of the vane, the tongue maintaining the air flow against the vane wall. A plurality of radially extending, axially spaced ribs are provided along the interior wall surfaces of the vane opposite the surfaces of the tongue to provide turbulence in the air flow. Additionally, substantially hemispherical projections are interspersed between the ribs to enhance the turbulation. A plurality of radially spaced openings are formed through the trailing edge of the vane for receiving the cooling air from the trailing edge cavity for cooling the trailing edge, the air exiting into the hot gas stream.

In a preferred embodiment according to the present invention, there is provided a closed circuit air-cooled stator vane segment comprising inner and outer walls spaced from one another, a vane extending between the inner and outer walls and having leading and trailing edges, the vane including discrete leading edge, trailing edge and intermediate cavities between the leading and trailing edges and extending radially of the vane, first and second air inlets for supplying cooling air to the leading edge and trailing edge cavities, an insert in the leading edge cavity for receiving cooling air from the first air inlet and having impingement openings for directing the cooling air against interior wall surfaces of the leading edge cavity for impingement cooling of the vane about the leading edge cavity, an insert in the intermediate cavity for receiving cooling air and having impingement openings for directing the cooling air against interior wall surfaces of the intermediate cavity for impingement cooling of the vane about the intermediate cavity and the trailing edge cavity through the vane lying in communication with the second inlet for receiving cooling air therefrom and having an outlet at a radially inner end thereof, the outlet including a passage for directing spent cooling air into a wheelspace between adjacent turbine stages.

In a further preferred embodiment according to the present invention, there is provided an open circuit air-cooled stator vane segment comprising inner and outer walls spaced from one another, a vane extending between the inner and outer walls and having leading and trailing edges, the vane including discrete leading edge, trailing edge and intermediate cavities between the leading and trailing edges and extending radially of the vane, first and second air inlets for supplying cooling air to the leading edge and trailing edge cavities, an insert in the leading edge cavity for receiving cooling air from the first air inlet and having impingement openings for directing the cooling air against interior wall surfaces of the leading edge cavity for impingement cooling of the vane about the leading edge cavity, an insert in the trailing edge cavity for receiving cooling air from the second air inlet and having impingement openings for directing the cooling air against interior wall surfaces of the vane for impingement cooling of the vane about the aft cavity, the trailing edge cavity having openings for delivery of cooling air through the trailing edge of the vane and an insert in the intermediate cavity having an air inlet adjacent the outer wall and an outlet adjacent the inner wall, the intermediate insert having an internal passage dedicated for supplying cooling air radially inwardly from the inlet to the outlet and into a wheelspace between adjacent turbine stages.

Accordingly, it is a primary object of the present invention to provide novel and improved closed and open air cooling circuits for cooling the nozzles of a turbine with each circuit having a dedicated passage for wheelspace purge.

BEST MODE FOR CARRYING OUT THE INVENTION

Figure 2:
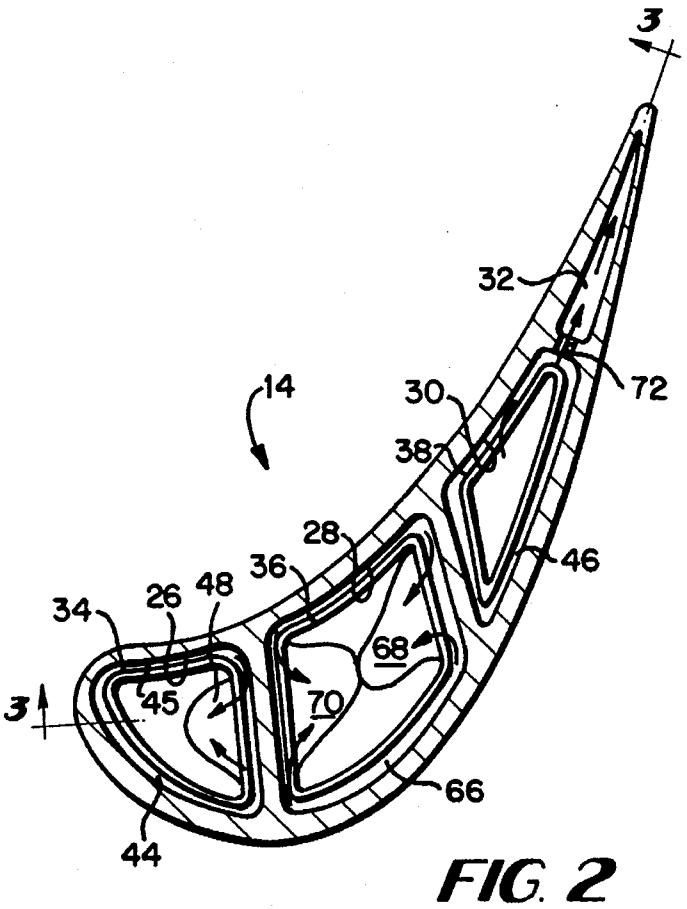
FIG. 2 is an enlarged cross-sectional view thereof taken generally about on line 2—2 in FIG. 1.
Figure 1:
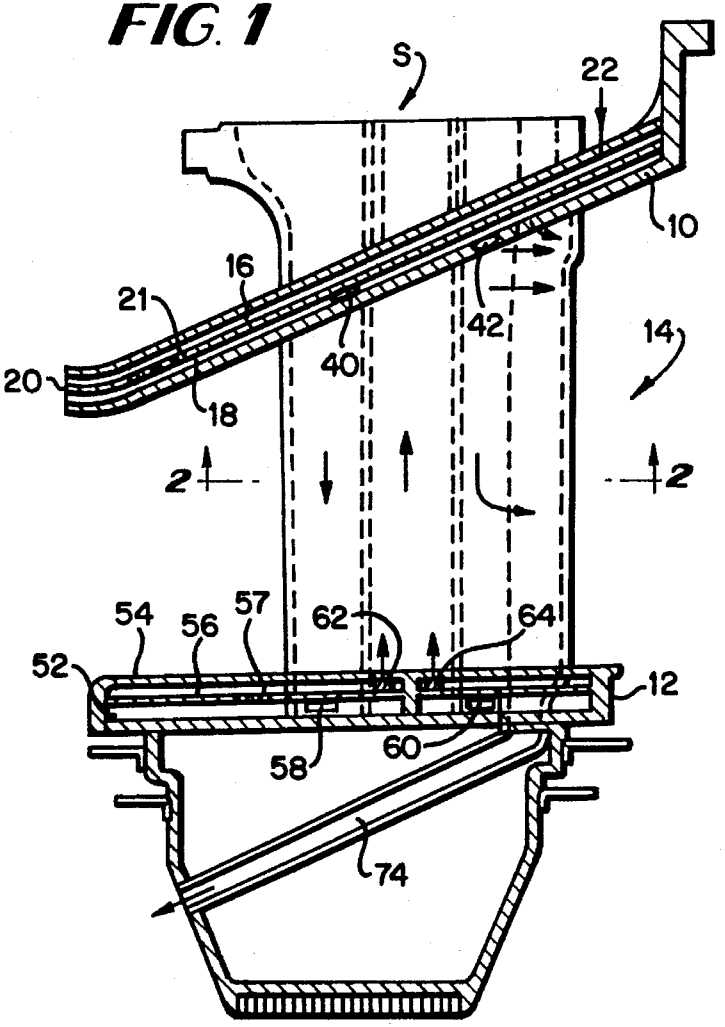
FIG. 1 is a cross-sectional view of a stator vane segment according to the present invention.

Referring now to FIGS. 1 and 2, there is illustrated a nozzle vane segment S having a closed circuit air cooling system according to the present invention. The nozzle segment S includes outer and inner walls 10 and 12 having one or more stator vanes 14 extending radially therebetween. As in prior application Ser. No. 08/414,697 (Attorney Docket No. 839-354), the disclosure of which is incorporated herein by reference, the outer wall 10 is connected to a support shell, not shown, and is divided into radially outer and inner plenums 16 and 18, respectively, divided by an impingement plate 20. An air inlet 22 is provided to the outer plenum 16 whereby cooling air fills the outer plenum and passes through openings 21 in impingement plate 20 for impingement cooling of the radially inner surface of the outer wall 10.

Referring to FIG. 2, the vane 14 is divided into a plurality of discrete, radially extending cavities. For example, there is provided a leading edge cavity 26, an intermediate cavity 28, an aft cavity 30, and a trailing edge cavity 32. Elongated inserts 34, 36 and 38 are disposed in the leading edge, intermediate and aft cavities and through which spent impingement cooling air flows in radial directions. As in the prior referenced application Ser. No. 08/414,697 (Attorney Docket No. 839-354), the walls of the vane 14 projecting through the outer wall 10 have openings 40 and 42 communicating with the inner plenum 18 for supplying cooling air to the passages within inserts 34 and 38 of the leading edge and aft cavities. Each insert has a plurality of closely spaced apertures 24 extending through the wall of the insert in opposition to the adjacent wall surface of the vane. Consequently, flow of cooling air radially inwardly from the plenum 18 flows into the inserts and outwardly through the apertures for impingement cooling of the adjacent walls of the vane. Each of the leading edge and aft cavities 26 and 30 have radially spaced, generally axially extending ribs 44 and 46, respectively, along the interior wall surfaces of the vane for directing the spent impingement cooling air flow generally in an aft direction. The leading edge insert 34 includes a recessed channel 48 along its rear face for receiving the spent impingement cooling air flow and directing the flow radially inwardly toward the inner wall 12.

The inner wall 12 includes radially inner and outer plenums 52 and 54 having an impingement plate 56 therebetween. One or more openings 58 are provided adjacent the radially inner end of the leading edge cavity for flowing the spent impingement cooling air into the radially inner cavity 52. A similar opening 60 is disposed through a wall of the vane adjacent the aft cavity for flowing cooling air from the aft cavity into the plenum 52. The cooling air from plenum 52 flows through the openings 57 in impingement plate 56 for impingement cooling of the inner wall surface of the inner wall 12 and through openings 62 and 64 for return via the intermediate cavity 28.

The insert 36 in intermediate cavity 28 similarly has a plurality of apertures through its side walls in opposition to the side walls of the vane. The intermediate cavity 28 also has a plurality of radially spaced, axially extending ribs 66. Thus, the cooling air flowing into openings 62 and 64 flows into the insert 36 and outwardly through the apertures for impingement cooling of the adjacent vane surfaces. The spent impingement cooling air is directed by the ribs 66 into channels 68 and 70 along the rear and forward sides of insert 36 for flow in a radially outward direction.

Figure 3:
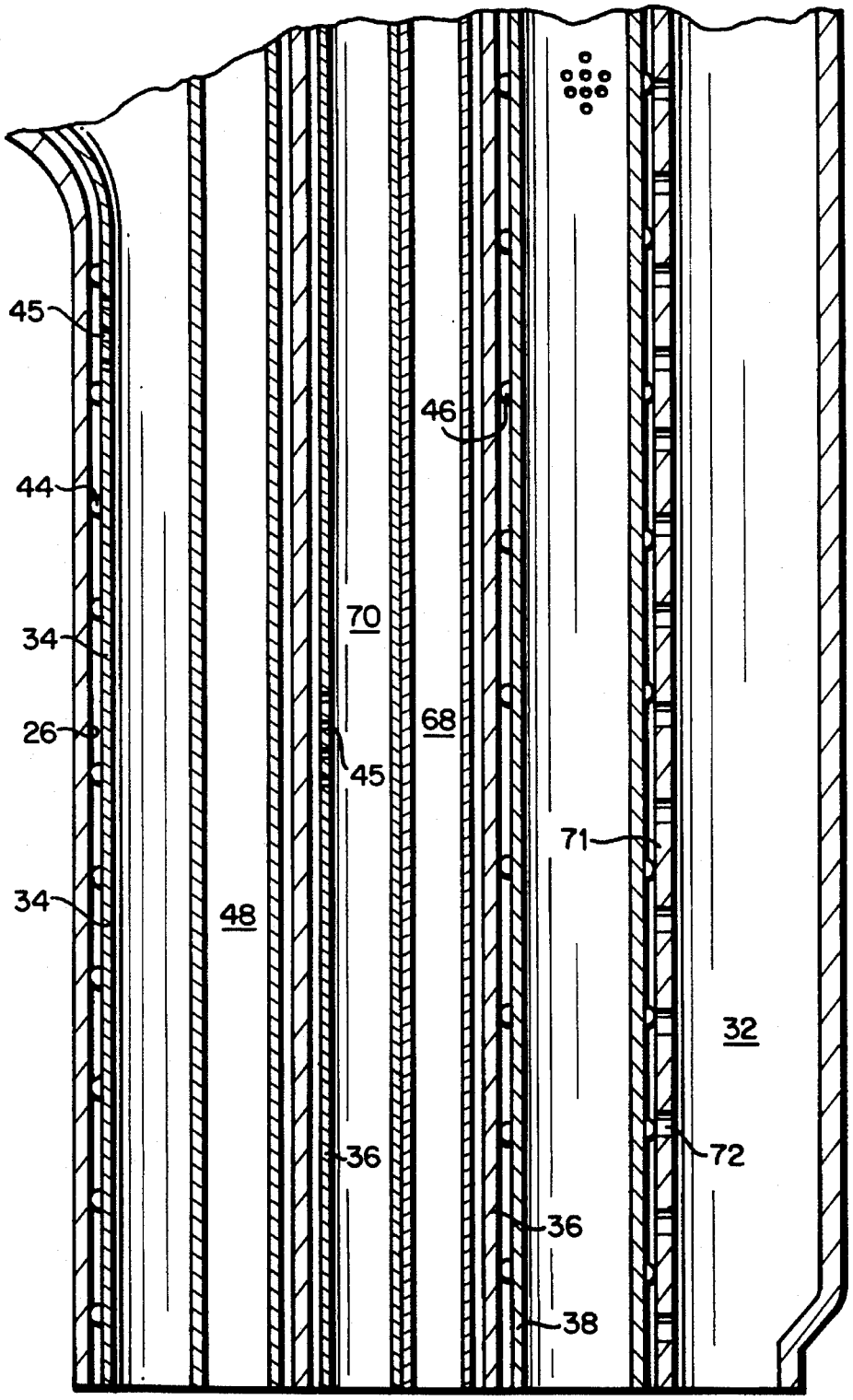
FIG. 3 is an enlarged cross-sectional view taken generally about on line 3—3 of FIG. 2.

From a review of FIGS. 1–3, it will be appreciated that a plurality of openings 72 are provided through the rib 71 extending radially between the aft cavity 30 and the trailing edge cavity 32. Spent cooling air flow is thus directed by the ribs 46 in the aft cavity in a rearward direction for flow through the openings 72 into the trailing edge cavity 32. As illustrated in FIG. 1, the radially inner end of the trailing edge cavity 32 has an outlet for directing cooling air through a passage 74 into the wheelspace between adjacent stages of the turbine.

Figure 4:
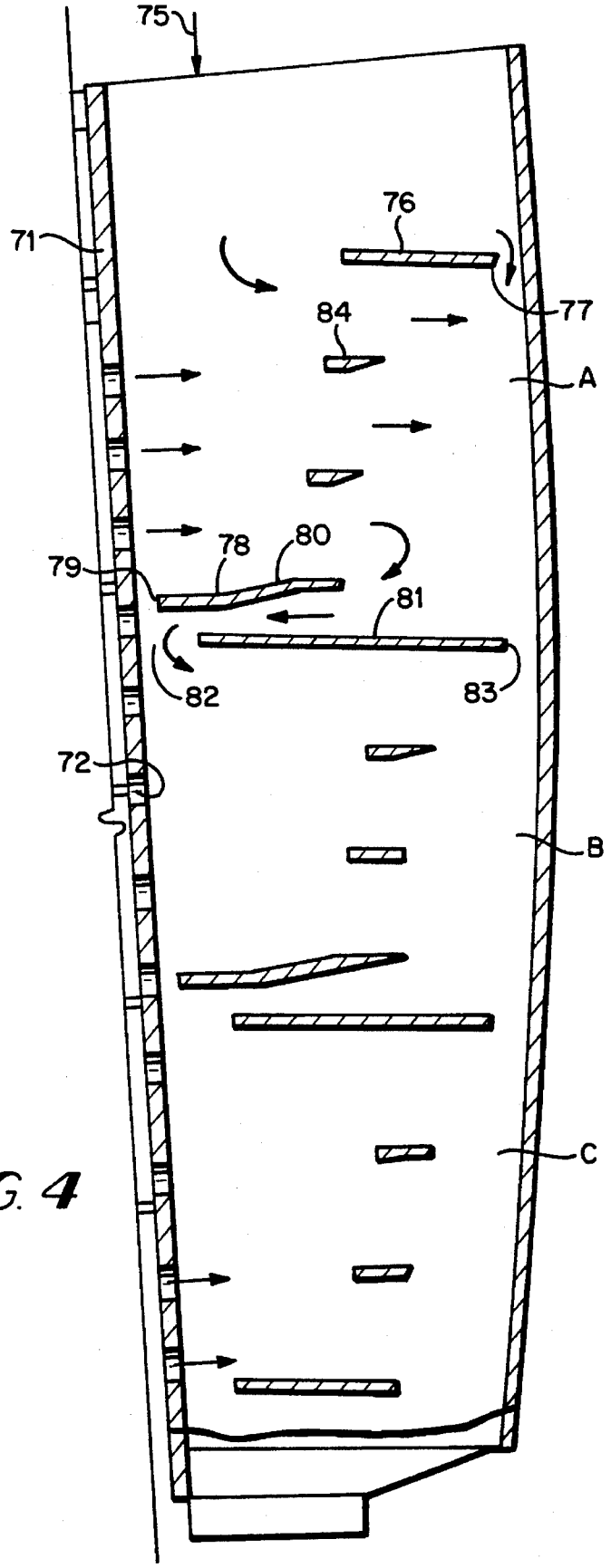
FIG. 4 is an enlarged cross-sectional view of the trailing edge cavity illustrating the flow diverting members.

The trailing edge cavity 32 is illustrated in detail in FIG. 4. Trailing edge cavity 32 may be supplied with air extracted from the turbine compressor and supplied through an inlet schematically illustrated in FIG. 4 at 75. The cavity is essentially divided into three radially spaced sections, although it will be appreciated that fewer or additional sections may be provided and that in each section, the flow pattern is essentially the same. In the first section, there is provided a first guide vane 76 which extends between the opposite converging walls defining the cavity 32 and lies short at opposite ends relative to the rib 71 and the trailing edge. The first guide vane 76 is located axially in the cavity such that a substantial opening for receiving the radially inwardly directed flow of cooling air is provided between the forward end of guide vane 76 and rib 71. In contrast, the rear or aft end of guide vane 76 is spaced from the trailing edge and wall by a small opening 77, affording bypass flow of cooling medium, i.e., air, in the direction of the arrow.

A second guide vane 78 is provided radially inwardly of the first guide vane 76. The second guide vane 78 extends between the opposite converging walls of the cavity 32 and is located axially forwardly in cavity 32. Thus, the forward end of the second guide vane 78 defines with the rib 71 a bypass opening 79 for flowing cooling medium directly radially inwardly past second guide vane 78. The aft or rear end of second guide vane 78 is spaced axially from the rear trailing edge end wall to define an enlarged opening for receiving the flow from radially outermost portions of the trailing edge cavity. The second guide vane 78 also includes a portion 80 angled in a radially outward direction from front to rear as illustrated.

A third guide vane 81 is disposed at a location radially inwardly of the first and second guide vanes 76 and 78, respectively, and extends between the convergent walls of the trailing edge cavity. The forward end of guide vane 81 defines with the rib 71 a flow opening 82 for flowing the majority of the cooling medium from locations radially outwardly of the third guide vane 81 in a direction radially inwardly to the next cooling section. The rear or aft end of the third guide vane 81 is spaced from the trailing edge end wall to define a bypass opening 83.

Between the first and second guide vanes 76 and 78, respectively, there are provided one or more intermediate guide vanes 84 which likewise extend between the convergent walls of the trailing edge cavity 32. Intermediate guide vanes 84 are considerably shorter in length in an axial direction than the first, second and third guide vanes and are also staggered axially forwardly in a radially inward direction.

From a review of FIG. 4, a plurality of cooling sections A, B and C are disposed in a radially inward direction along the trailing edge cavity 32. The sections are substantially identical in configuration to one another, with each section having a second guide vane, as well as intermediate guide vanes, with the third guide vane of the first section A serving as the first guide vane in the subsequent cooling section B. Similarly, the third guide vane in cooling section B serves as the first guide vane in cooling section C.

The operation of the closed circuit cooling air system of FIGS. 1–4 will now be described. Extraction air from the compressor is supplied via an inlet 22 to the outer plenum 20 of the outer wall 10. The cooling air flows through the impingement openings of impingement plate 20 for impingement cooling of the outer wall surface of the segment. The spent impingement cooling air flows through openings 40 and 42 into the leading edge cavity insert 34, the aft cavity insert 38 and into:the trailing edge 32. The cooling air in the leading and aft cavities 26 and 30, respectively, flows through the impingement apertures in the inserts 34 and 38 for cooling adjacent wall portions of the vane. The spent cooling air flows into the channel 48 in the leading edge insert 34, as well as radially inwardly along the interior of insert 38, where both flows flow into the radially inner plenum 52 of the inner wall 12. The air flows radially outwardly through the impingement plate 56 into plenum 54 for impingement cooling of the inner wall surface of the segment. The air in plenum 54 flows through openings 62 and 64 into the interior of the intermediate cavity insert 36 for flow in a radial outward direction. The flow of cooling air passes through the apertures of insert 36 for impingement cooling of the adjacent vane surfaces. The spent impingement cooling air is directed by the flow ribs 66 into the channels 68 and 70 for flow radially outwardly to an exhaust port.

The cooling air supplied to the insert 38 of the aft cavity passes through the apertures of the insert for impingement cooling of the adjacent walls of the vane. The flow ribs 46 direct the spent impingement cooling air through the openings 72 into the trailing edge cavity 32. In the trailing edge cavity 32, the radially inwardly directed flow passing through inlet 75 turns from its radially inward direction to an axial direction for flow in a direction toward the trailing edge in the region between the first and second guide vanes 76 and 78, respectively. The flow through the bypass opening 77 is to prevent a stagnation area above the first guide vane 76 and to provide a radially inwardly directional flow. The majority of the flow thus passes radially inwardly past first guide vane 76 and combines with the axially directed flow through flow openings 72 for flow axially toward and for impingement cooling of the trailing edge. The convergent flow in the region between the first and second guide vanes 76 and 78, respectively, exhibits a boundary layer character near the walls which remains substantially constant over a large center portion. As the flow approaches the apex of the flow channel, i.e., the trailing edge, vortices form and remove heat from the trailing edge. With the vortices formed and turning axially forwardly, the flow is forced in a radially inward direction by the momentum associated with the incoming flow between the intermediate guide vanes 84 and the first and second guide vanes 76 and 78, respectively, and the flow through ribs 72, as well as by the bypass flow through opening 77. Consequently, the returning flow moves toward the opening between the second guide vane 78 and third guide vane 81. The majority of the returning flow passes between the second and third guide vanes 78 and 81, respectively, as indicated by the arrow, mixes with bypass flow flowing radially inwardly through the bypass opening 79 and passes through the opening 82 of the third guide vane 81 into the second section B. Flow in the second section combines with the flow through the opening 72 in rib 71, and thus flows in a general axial direction toward the trailing edge, where the flow pattern is repeated. Thus, the flow pattern in the trailing edge cavity 32 is highly turbulent. The highly turbulent flow in the trailing edge cavity cools the trailing edge and passes through the outlet and into passage 74 for exhausting into the wheelspace of adjacent stages, affording wheelspace purge.

Figure 6:
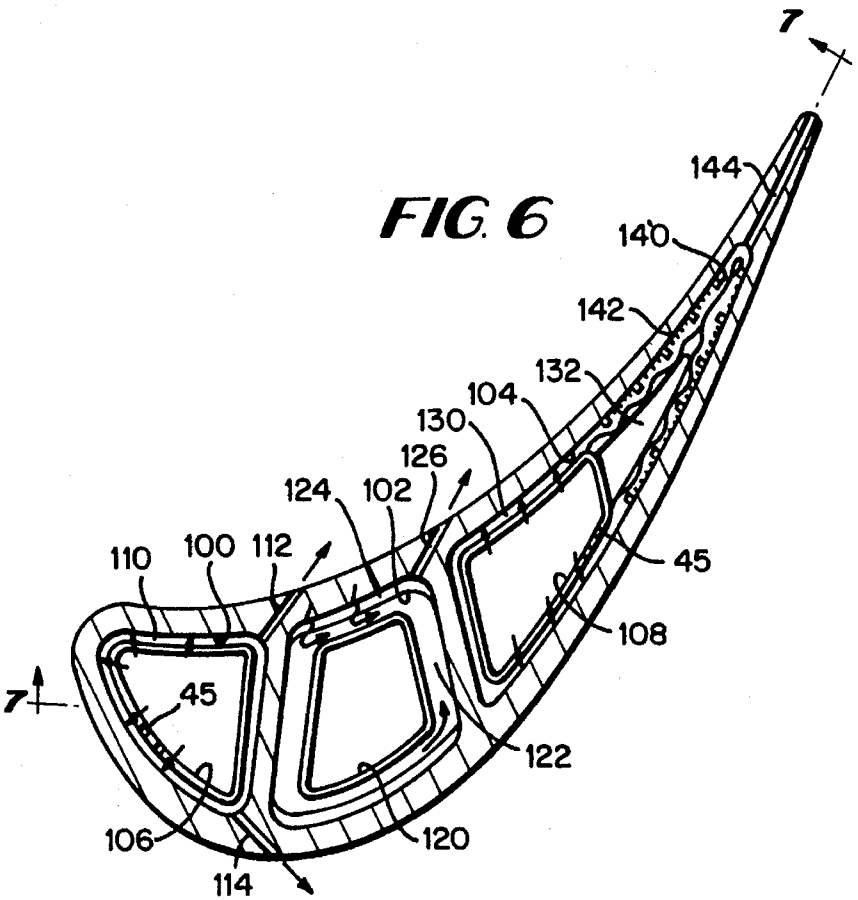
FIG. 6 is an enlarged cross-sectional view thereof taken generally about on line 6—6 in FIG. 5.
Figure 5:
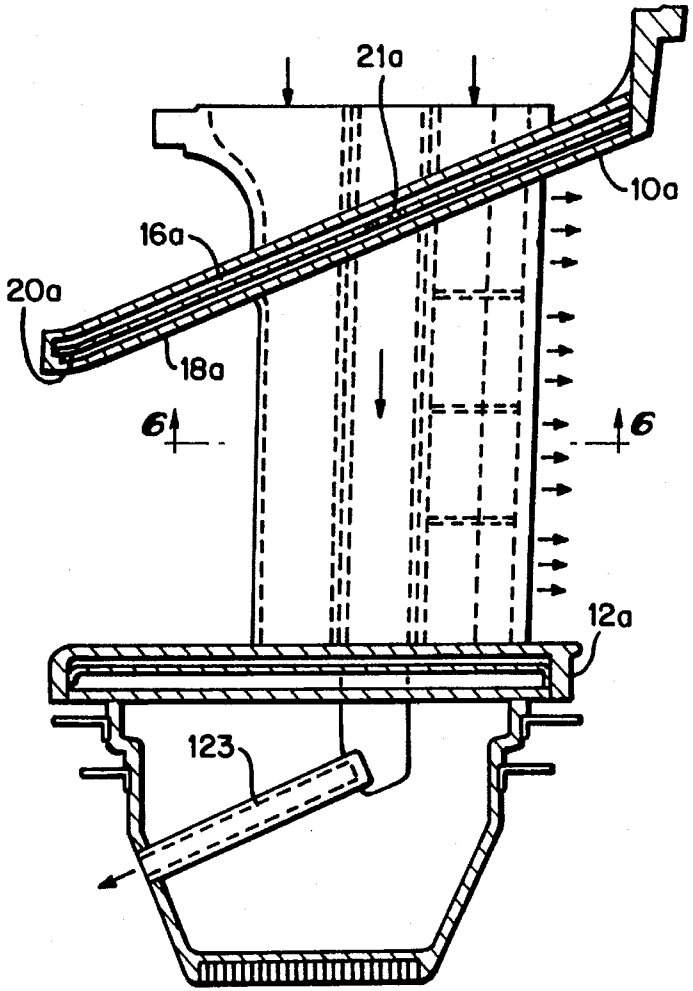
FIG. 5 is a view similar to FIG. 1 illustrating a stator vane segment used for open-circuit air cooling.
Figure 7:
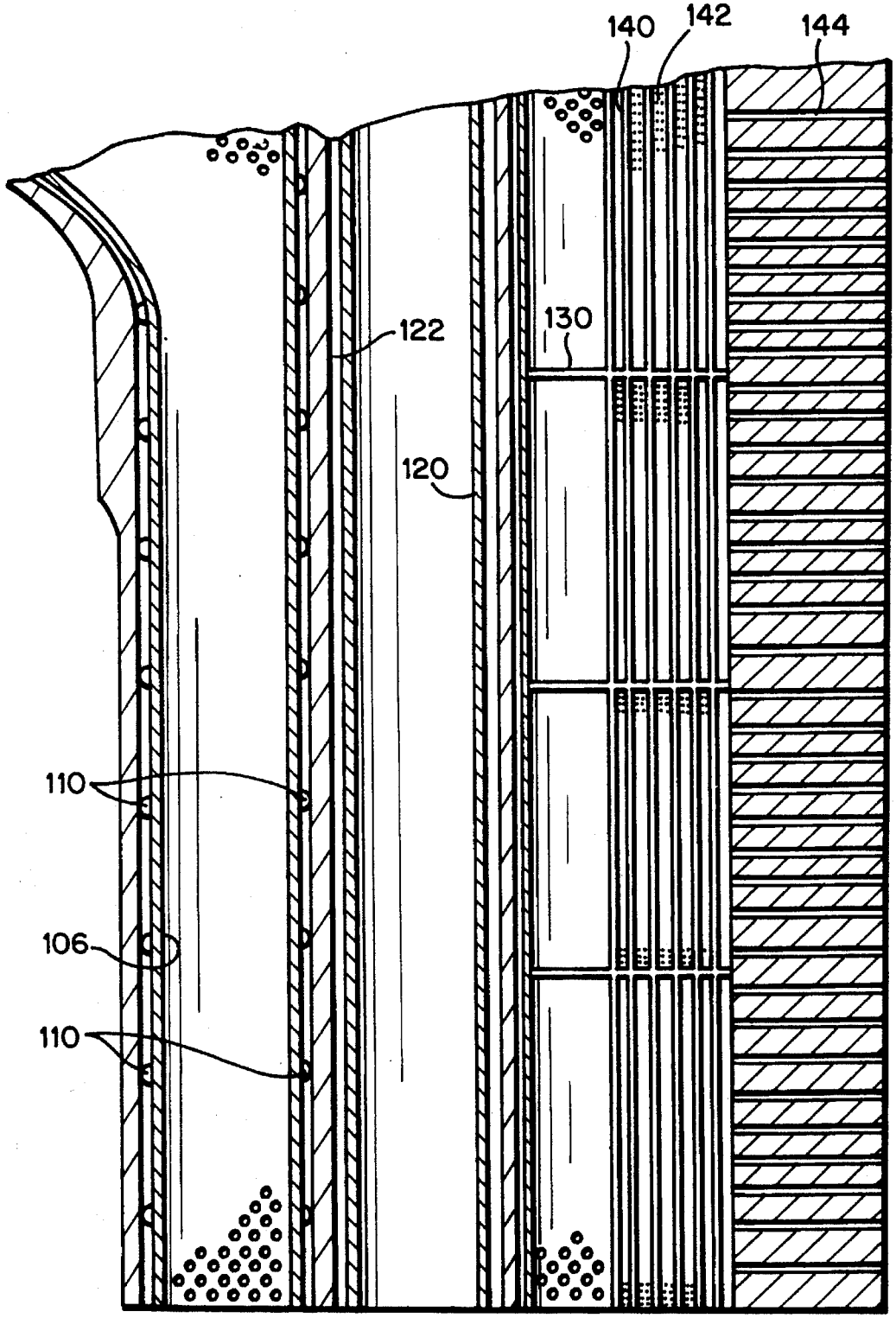
FIG. 7 is a cross-sectional view thereof taken generally about on line 7—7 in FIG. 6.

Referring now to the embodiments hereof illustrated in FIGS. 5–7, there is provided an open circuit air cooling system for the stator vane segment. In this form, the outer and inner walls 10*a* and 12*a*, respectively, of the segment are essentially identical to the inner and outer walls 10 and 12 illustrated in the embodiment hereof of FIGS. 1–4. Thus, cooling air inlet to the outer wall 10*a* passes into outer plenum 16*a*, through impingement openings 21*a* of impingement plate 20*a* and into the inner plenum 18*a* for impingement cooling of the inner wall surface of wall 10*a*. In this form, however, there are provided three radially extending cavities, namely, a leading edge cavity 100, an intermediate cavity 102, and a trailing edge cavity 104. The leading edge cavity 100 and trailing edge cavity 104 are each provided with inserts 106 and 108, respectively, which have apertures 45 through their side walls, supplying adjacent corresponding portions of the vane wall. Consequently, air supplied from the inner plenum 18*a* passes radially inwardly along inserts 106 and 108 and passes through the apertures for impingement cooling of the adjacent wall surfaces. As in the prior embodiments, axially extending, radially spaced ribs 110 are provided in the leading edge cavity 100. In this form, however, there is provided a plurality of radially spaced openings 112 and 114 on opposite sides of the vane in communication with the spent impingement cooling air circulating in the leading edge cavity between the insert and the walls of that cavity. Thus, the spent impingement cooling air flows through openings 112 and 114 into the hot gas path for thin film cooling of the vane. The radially inner ends of the leading edge cavity 100 and the trailing edge cavity 104 are closed.

An insert 120 is also provided the intermediate cavity 102. The insert 120 is spaced from the walls of the vane and the ribs between adjacent cavities. Instead of impingement openings through insert 120, insert 120 is closed to channel cooling air directly to a passage 123 in the diaphragm for delivery of cooling air to the wheelspace between adjacent stages. Air is supplied to the insert 120 from the compressor. Additionally, a channel 122 is formed between the insert 120 and the walls of the vane and the ribs. Cooling air is supplied channel 122 from a suitable source. A plurality of radially spaced, axially extending ribs 124 are also provided on the walls of the vane in channel 122. The cooling air supplied to channel 122 exits through openings 126 radially spaced one from the other on the pressure side of the airfoil and into the gas path for thin film cooling.

The trailing edge cavity 104 also includes a plurality of radially spaced, axially extending ribs 130 for directing the spent cooling air impingement flow from the space between the insert 108 and the walls of the vane in a rearward direction toward the trailing edge. The insert 108 also includes a rearwardly projecting tongue 132 having side walls spaced closely adjacent the interior walls of the vane. Additionally, opposite the tongue 132 and rearwardly extending portions of the trailing edge cavity, there are provided a plurality of axially spaced, radially extending ribs 140. Between the ribs, the wall surface of the vane is provided with a plurality of inwardly projecting dimples or hemispherical projections 142. Also, a plurality of axially extending, radially spaced passages 144 are provided through the trailing edge of the vane for receiving the spent impingement cooling air flow passing into the trailing edge cavity and transmitting the flow through the trailing edge into the hot gas stream. This flow through the trailing edge thus cools the trailing edge.

As illustrated in FIG. 6, the flow pattern in the trailing edge cavity is illustrated as wavy lines passing over the ribs 140 and dimples 142. The ribs 140 and dimples 142, in combination, provide a highly turbulent air flow for cooling the wall surfaces of the vane.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. An open circuit air-cooled stator vane segment comprising:

inner and outer walls spaced from one another;

a vane extending between said inner and outer walls and having leading and trailing edges, said vane including discrete leading edge, trailing edge and intermediate cavities between the leading and trailing edges and extending radially of said vane, first and second air inlets for supplying cooling air to said leading edge and trailing edge cavities, respectively;

an insert in said leading edge cavity for receiving cooling air from said first air inlet and having impingement openings for directing the cooling air against interior wall surfaces of said leading edge cavity for impingement cooling of the vane about said leading edge cavity;

an insert in said trailing edge cavity for receiving cooling air from said second air inlet and having impingement openings for directing the cooling air against interior wall surfaces of said vane for impingement cooling of said vane about said trailing edge cavity;

said trailing edge cavity having openings for delivery of cooling air through the trailing edge of said vane; and an insert in said intermediate cavity having an air inlet adjacent said outer wall and an outlet adjacent said inner wall, said intermediate insert having an internal passage dedicated for supplying cooling air radially inwardly from said inlet to said outlet and into a wheelspace between adjacent turbine stages.

2. A stator vane segment according to claim 1 including a plurality of generally radially extending, axially spaced ribs formed along the interior wall surfaces of said vane opposite said trailing edge insert for creating a turbulent flow of cooling air from said trailing edge insert along said interior wall surfaces toward said openings.

3. A stator vane segment according to claim 2 including a plurality of protuberances along said interior wall surfaces between said ribs affording enhanced turbulated air flow.

4. A closed circuit air-cooled stator vane segment comprising:

inner and outer walls spaced from one another;

a vane extending between said inner and outer walls and having leading and trailing edges, said vane including discrete leading edge, trailing edge and intermediate cavities between the leading and trailing edges and extending radially of said vane, first and second air inlets for supplying cooling air to said leading edge and trailing edge cavities, respectively;

an insert in said leading edge cavity for receiving cooling air from said first air inlet and having impingement openings for directing the cooling air against interior wall surfaces of said leading edge cavity for impingement cooling of the vane about said leading edge cavity;

an insert in said intermediate cavity for receiving cooling air and having impingement openings for directing the cooling air against interior wall surfaces of said intermediate cavity for impingement cooling of said vane about said intermediate cavity;

said trailing edge cavity through said vane lying in communication with said second inlet for receiving cooling air therefrom and having an outlet at a radially inner end thereof, said outlet including a passage for directing spent cooling air into a wheelspace between adjacent turbine stages; and said inner wall including a flow passage interconnecting a radially inner end of said leading edge cavity and an inner end of said intermediate cavity whereby air in said leading edge and intermediate cavities flows in generally opposite radial directions.

5. A closed circuit air-cooled stator vane segment comprising:

inner and outer walls spaced from one another;

a vane extending between said inner and outer walls and having leading and trailing edges, said vane including discrete leading edge, trailing edge and intermediate cavities between the leading and trailing edges and extending radially of said vane, first and second air inlets for supplying cooling air to said leading edge and trailing edge cavities, respectively;

an insert in said leading edge cavity for receiving cooling air from said first air inlet and having impingement openings for directing the cooling air against interior wall surfaces of said leading edge cavity for impingement cooling of the vane about said leading edge cavity;

an insert in said intermediate cavity for receiving cooling air and having impingement openings for directing the cooling air against interior wall surfaces of said intermediate cavity for impingement cooling of said vane about said intermediate cavity;

said trailing edge cavity through said vane lying in communication with said second inlet for receiving cooling air therefrom and having an outlet at a radially inner end thereof, said outlet including a passage for directing spent cooling air into a wheelspace between adjacent turbine stages; and a discrete aft cavity between said intermediate cavity and said trailing edge cavity, an insert in said aft cavity for receiving cooling air and having impingement openings for directing the cooling air adjacent interior wall surfaces of said vane for impingement cooling of said vane about said aft cavity, a plurality of ribs projecting inwardly of said interior wall surfaces of said vane in said aft cavity at spaced locations therealong to define flow chambers between said interior wall surface and said insert in said aft cavity, a radially extending rib between said aft cavity and said trailing edge cavity including a plurality of openings in communication with said flow chambers for flowing air from said aft cavity into said trailing edge cavity.

6. A closed circuit air-cooled stator vane segment comprising:

inner and outer walls spaced from one another;

a vane extending between said inner and outer walls and having leading and trailing edges, said vane including discrete leading edge, trailing edge and intermediate cavities between the leading and trailing edges and extending radially of said vane, first and second air inlets for supplying cooling air to said leading edge and trailing edge cavities, respectively;

an insert in said leading edge cavity for receiving cooling air from said first air inlet and having impingement openings for directing the cooling air against interior wall surfaces of said leading edge cavity for impingement cooling of the vane about said leading edge cavity;

an insert in said intermediate cavity for receiving cooling air and having impingement openings for directing the cooling air against interior wall surfaces of said intermediate cavity for impingement cooling of said vane about said intermediate cavity;

said trailing edge cavity through said vane lying in communication with said second inlet for receiving cooling air therefrom and having an outlet at a radially inner end thereof, said outlet including a passage for directing spent cooling air into a wheelspace between adjacent turbine stages; and a discrete aft cavity between said intermediate cavity and said trailing edge cavity, an insert in said aft cavity for receiving cooling air and having impingement openings for directing the cooling air against interior wall surfaces of said vane adjacent said aft cavity for impingement cooling of said vane, a plurality of ribs projecting inwardly of said interior wall surfaces of each said leading edge cavity, said intermediate cavity and said aft cavity at spaced locations therealong to define flow chambers between said interior wall surfaces and said inserts, at least two of said inserts having at least one radially extending flow channel each in communication with said flow chambers formed by respective inserts for directing spent cooling air from the respective cavity.

7. A closed circuit air-cooled stator vane segment comprising:

inner and outer walls spaced from one another;

a vane extending between said inner and outer walls and having leading and trailing edges, said vane including discrete leading edge, trailing edge and intermediate cavities between the leading and trailing edges and extending radially of said vane, first and second air inlets for supplying cooling air to said leading edge and trailing edge cavities, respectively;

an insert in said leading edge cavity for receiving cooling air from said first air inlet and having impingement openings for directing the cooling air against interior wall surfaces of said leading edge cavity for impingement cooling of the vane about said leading edge cavity;

an insert in said intermediate cavity for receiving cooling air and having impingement openings for directing the cooling air against interior wall surfaces of said intermediate cavity for impingement cooling of said vane about said intermediate cavity;

openings through side walls of said vane in communication with said leading edge cavity and said intermediate cavity, respectively, for receiving spent impingement cooling air therefrom and directing the spent impingement cooling air externally of the vane for thin film cooling thereof;

said trailing edge cavity through said vane lying in communication with said second inlet for receiving cooling air therefrom; and an insert in said trailing edge cavity for receiving cooling air and having impingement openings for directing cooling air against interior wall surfaces of said trailing edge cavity for impingement cooling of said vane about said trailing edge cavity, said trailing edge cavity having trailing edge openings for delivery of cooling air through the trailing edge of the vane.

8. A closed circuit air-cooled stator vane segment comprising:

inner and outer walls spaced from one another;

a vane extending between said inner and outer walls and having leading and trailing edges, said vane including discrete leading edge, intermediate, aft and trailing edge cavities between the leading and trailing edges and extending radially of said vane, first and second air inlets for supplying cooling air to said leading edge and aft cavities, respectively;

an insert in said leading edge cavity for receiving cooling air from said first air inlet and having impingement openings for directing the cooling air against interior wall surfaces of said leading edge cavity for impingement cooling of the vane about said leading edge cavity;

an insert in said intermediate cavity for receiving cooling air and having impingement openings for directing the cooling air against interior wall surfaces of said intermediate cavity for impingement cooling of said vane about said intermediate cavity;

said inner wall including a flow passage interconnecting a radially inner end of said leading edge cavity and an inner end of said intermediate cavity whereby air in said leading edge and intermediate cavities flows in a closed circuit within said vane in generally opposite radial directions;

said aft cavity through said vane lying in communication with said second inlet for receiving cooling air therefrom; and a plurality of openings spaced radially one from another along said vane providing communication between said aft cavity and said trailing edge cavity for flowing cooling air from said aft cavity into said trailing edge cavity, said trailing edge cavity having an outlet for the cooling air whereby the cooling air flows from said inlet through said aft and trailing edge cavities in a closed circuit with said vane.

9. An open circuit air-cooled stator vane segment comprising:

inner and outer walls spaced from one another;

a vane extending between said inner and outer walls and having leading and trailing edges, said vane including discrete leading edge, trailing edge and intermediate cavities between the leading and trailing edges and extending radially of said vane, first and second air inlets for supplying cooling air to said leading edge and trailing edge cavities, respectively;

an insert in said leading edge cavity for receiving cooling air from said first air inlet and having impingement openings for directing the cooling air against interior wall surfaces of said leading edge cavity for impingement cooling of the vane about said leading edge cavity;

an insert in said trailing edge cavity for receiving cooling air from said second air inlet and having impingement openings for directing the cooling air against interior wall surfaces of said vane for impingement cooling of said vane about said trailing edge;

said trailing edge cavity having openings for delivery of cooling air through the trailing edge of said vane;

an insert in said intermediate cavity having an air inlet adjacent said outer wall and an outlet adjacent said inner wall, said intermediate insert having an internal passage dedicated for supplying cooling air radially inwardly from said inlet to said outlet and into a wheelspace between adjacent turbine stages; and a tongue in said trailing edge cavity between said trailing edge insert and said trailing edge, said tongue having side wall surfaces spaced from interior wall surfaces of said vane opposite said side wall surfaces defining flow paths for directing cooling air along the interior wall surfaces of the vane toward said trailing edge openings.

10. An open circuit air-cooled stator vane segment comprising:

inner and outer walls spaced from one another;

a vane extending between said inner and outer walls and having leading and trailing edges, said vane including discrete leading edge, trailing edge and intermediate cavities between the leading and trailing edges and extending radially of said vane, first and second air inlets for supplying cooling air to said leading edge and trailing edge cavities, respectively;

an insert in said leading edge cavity for receiving cooling air from said first air inlet and having impingement openings for directing the cooling air against interior wall surfaces of said leading edge cavity for impingement cooling of the vane about said leading edge cavity;

an insert in said trailing edge cavity for receiving cooling air from said second air inlet and having impingement openings for directing the cooling air against interior wall surfaces of said vane for impingement cooling of said vane about said trailing edge cavity;

said trailing edge cavity having openings for delivery of cooling air through the trailing edge of said vane;

an insert in said intermediate cavity having an air inlet adjacent said outer wall and an outlet adjacent said inner wall, said intermediate insert having an internal passage dedicated for supplying cooling air radially inwardly from said inlet to said outlet and into a wheelspace between adjacent turbine stages; and a channel between said intermediate insert and interior wall surfaces of said vane opposite said insert, an inlet to said channel adjacent said outer wall for supplying air to said channel for radially inwardly directed flow, and openings in said interior wall surfaces for flowing cooling air from said channel along exterior wall surfaces of said vane for thin film cooling thereof.

11. A stator vane segment according to claim 10 including a plurality of generally radially directed, axially spaced ribs formed along the interior wall surfaces of said vane opposite said tongue for creating a turbulent flow of cooling air from said trailing edge insert along said interior wall surfaces opposite said tongue toward said openings.

12. A stator vane segment according to claim 11 including a plurality of protuberances along said interior wall surfaces between said ribs affording enhanced turbulated air flow.

* * * * *